US005669789A

United States Patent [19]

Law

[11] Patent Number: 5,669,789

[45] Date of Patent: Sep. 23, 1997

[54] ELECTROMAGNETIC INTERFERENCE SUPPRESSING CONNECTOR ARRAY

[75] Inventor: Henry Hon Law, Berkeley Heights, N.J.

[73] Assignee: Lucent Technologies Inc., Murray Hill, N.J.

[21] Appl. No.: 746,183

[22] Filed: Nov. 6, 1996

Related U.S. Application Data

[63] Continuation of Ser. No. 403,325, Mar. 14, 1995, abandoned.

[51] Int. Cl.[6] ..... H01R 13/66

[52] U.S. Cl. ..... 439/620; 333/12; 439/931; 439/608

[58] Field of Search ..... 439/620, 931; 333/181, 182, 183, 184, 185

[56] References Cited

U.S. PATENT DOCUMENTS

| | | | |
|---|---|---|---|
| 4,758,808 | 7/1988 | Sasaki et al. | 333/185 |
| 4,761,147 | 8/1988 | Gauthier | 439/620 |
| 4,796,079 | 1/1989 | Hettiger | 333/12 |
| 4,875,862 | 10/1989 | Sakamoto et al. | 439/86 |
| 4,977,668 | 12/1990 | McKenzie | 439/931 |
| 5,266,055 | 11/1993 | Naito et al. | 439/620 |
| 5,340,334 | 8/1994 | Nguyen | 439/620 |
| 5,469,334 | 11/1995 | Balakrishnan | 333/185 |

OTHER PUBLICATIONS

P. Nyholm et al "EMI Protection in Consumer Portable Products," *Electronic Packaging and Production*, pp. 40–44 (1994).

C. Parker, "How to Select Ferrites and How They Work", *EMC Test and Design*, pp. 26–29 (1994).

*Primary Examiner*—Neil Abrams
*Assistant Examiner*—T. C. Patel
*Attorney, Agent, or Firm*—Glen E. Books

[57] ABSTRACT

In accordance with the invention, an EMI suppressing connector comprises a body of ferrite having a plurality of conductive channels and at least one planar surface. The channel walls are wholly or partially coated with conductive material which provides a conductive path extending through the body and the planar surface includes a pattern of coated conductive leads connected to the conductive channels. Preferably the connector is in the form of a rectangular parallelopiped, and the channels extend perpendicularly between two major surfaces. In one embodiment, the conductive material extends horizontally through the body and onto planar bottom. The conductive material on the planar bottom surface provides ready connection with contacts on a circuit board or IC package. In another embodiment, the conductive material extends vertically through the body and onto a planar bottom or top. The conductive material on the planar surface can be configured in any desired pattern to define fanouts or mappings from one set of contacts to another.

6 Claims, 2 Drawing Sheets

ELECTROMAGNETIC INTERFERENCE SUPPRESSING CONNECTOR ARRAY

This application is a continuation of application Ser. No. 08/403,325, filed Mar. 14, 1995, now abandoned.

FIELD OF THE INVENTION

This invention relates to electromagnetic interference (EMI) suppressing connectors and, in particular, to a device for providing an array of EMI suppressed connections to an electronic circuit board or IC package.

BACKGROUND OF THE INVENTION

As communications and consumer electronics moves to digital signaling with higher bit rates, suppression of electromagnetic interference assumes greater significance in product design. As portable products using microprocessors become common, there will be more potential sources of electromagnetic emission and more potential for interference by signals picked up. Moreover with higher bit rates, electromagnetic interference is a potential problem even within a complex unit such as a computer.

The most common approach to EMI suppression is to shield emitting and vulnerable components in metal cans. See, for example, P. Nyholm et at, "EMI Protection in Consumer Portable Products," *Electronic Packaging and Production*, pp. 40–44 (March 1994). This approach, however, becomes more difficult as bit rates increase. A more effective approach is shielding with soft ferrites. Cores, beads and connector plates have been used to provide such shielding. See C. Parker, "How to Select Ferrites and How They Work", *EMC Test and Design*, pp. 26–29 (January 1994). The difficulty with such devices is that they are difficult to use with electronic circuit boards and IC packages requiring a high density of connections. Accordingly, there is a need for a new EMI suppressing connector.

SUMMARY OF THE INVENTION

In accordance with the invention, an EMI suppressing connector comprises a body of ferrite having a plurality of conductive channels and at least one planar surface. The channel walls are wholly or partially coated with conductive material which provides a conductive path extending through the body and the planar surface includes a pattern of coated conductive leads connected to the conductive channels. Preferably the connector is in the form of a rectangular parallelopiped, and the channels extend perpendicularly between two major surfaces. In one embodiment, the conductive material extends horizontally through the body and onto planar bottom. The conductive material on the planar bottom surface provides ready connection with contacts on a circuit board or IC package. In another embodiment, the conductive material extends vertically through the body and onto a planar bottom or top. The conductive material on the planar surface can be configured in any desired pattern to define fanouts or mappings from one set of contacts to another.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that these drawings are for purposes of illustrating the invention and are not to scale.

DETAILED DESCRIPTION

Figure 1:
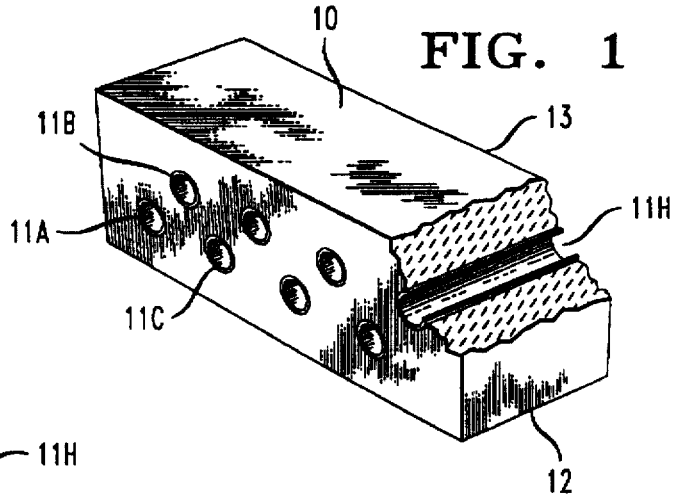
FIG. 1 is a perspective view of an EMI suppressing connector in accordance with a first embodiment of the invention.

Referring to the drawings, FIG. 1 illustrates an EMI suppressing connector comprising a body 10 of ferrite material having an array of channels 11A–11H for receiving conductors (not shown) and at least one planar surface 12 (here the bottom surface). The walls of channels 11A–11H are coated with conductive material which extends through the body 10 and over the body surface (here the back surface 13) onto the planar bottom surface 12. As illustrated, the body 10 is preferably in the form of a rectangular parallelopiped with the channels extending perpendicularly between a pair of major surfaces.

Figure 2:
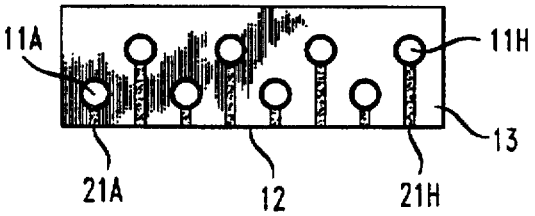
FIG. 2 shows the back surface of the FIG. 1 device.

The extension of the channel conductors can be seen in FIG. 2 which shows the back surface 13 having a linear array of conductors 21A–21H extending from channels 11A–11G down to bottom surface 12.

Figure 3:
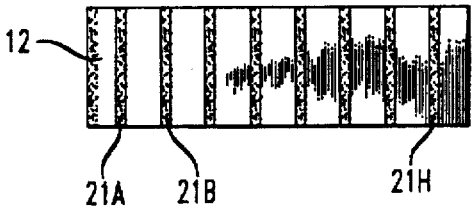
FIG. 3 shows the bottom surface of the FIG. 1 device.

FIG. 3 shows the planar bottom surface 12 with conductors 21A–21H extending around the edge across the planar bottom surface.

Figure 4:
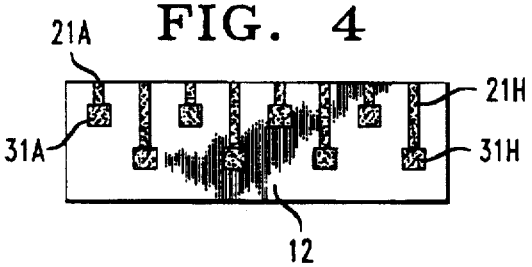
FIG. 4 shows an alternative bottom surface.

FIG. 4 is an alternative bottom surface 12 where the conductors 21A–21H contact an array of bonding pads 31A–31H for providing contact with a corresponding array of bonding pads on an electronic circuit board or IC package. It will be appreciated that by appropriate patterning of the conductors on the bottom surface, any one of conductors 21A–21H can be mapped to any one (or more) of bonding pads 31A–31H.

Figure 5:
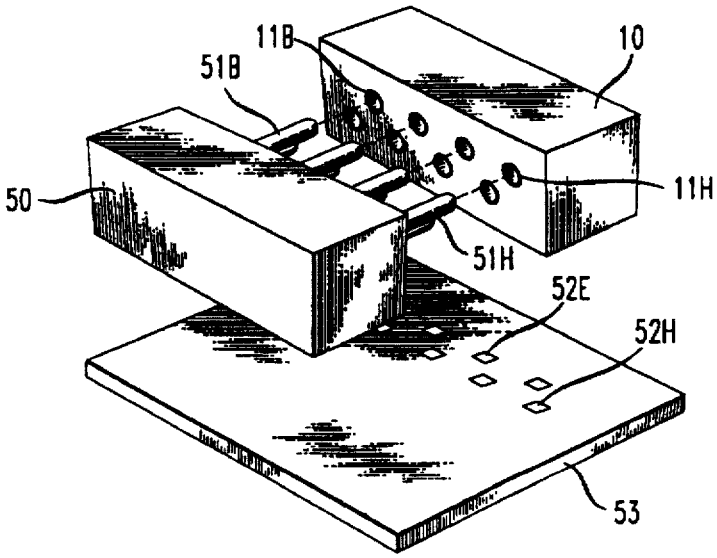
FIG. 5 illustrates the FIG. 1 device in use.

FIG. 5 illustrates the preferred use of the device. An array 50 of contact pins 51A–51H is inserted into corresponding array of channels 11A–11H. The conductive paths from channels 11A–11H extend to the array of bonding pads 31A–31H on the bottom surface (not shown). These bonding pads contact a corresponding array of bonding pads 52A–52H on a circuit board or IC package 53. Thus, the contact pins are provided with EMI suppressed contacts with the board or package.

Figure 6:
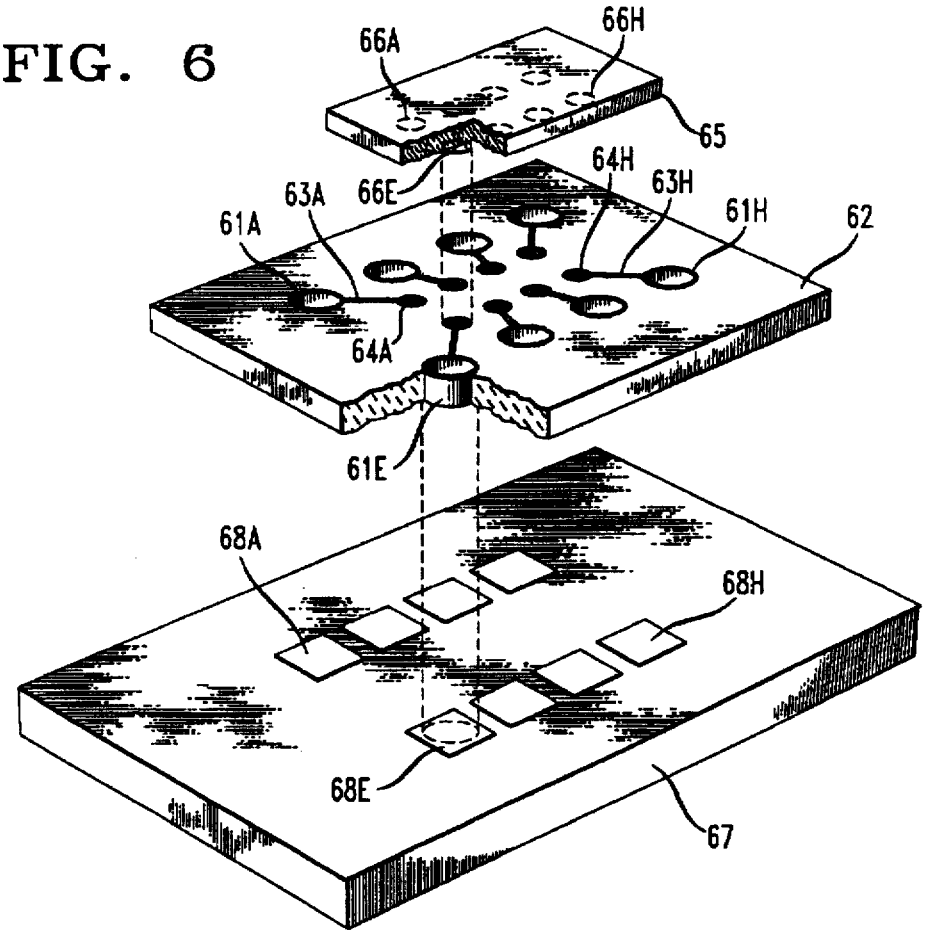
FIG. 6 is a perspective view of a second embodiment of the invention using vertical rather than horizontal channels.

FIG. 6 is a perspective view of an alternative embodiment of an EMI suppressing connector having vertical channels 61A–61H rather than horizontal channels. In this embodiment the channels preferably extend between to parallel planar horizontal surfaces 62, and the conductive material in the channels is advantageously continuous with a pattern of conductors 63A–63H on one or both planar surfaces. Here the conductors 63A–63H provide a fan-out pattern from a closely spaced array of contact pads 64A–64H. Thus, an integrated circuit (65) having a closely spaced array of bonding pads 66A–66H can be bonded to array 64A–64H on top of the device. The bottom of the device can be bonded to a circuit board 67 having more widely spaced array of contact pads 68A–68H as by soldering the conductive channels 61 to the pads 68. Continuous conductive EMI suppressed paths are provided from the integrated circuit 65 through the conductors 63A–63H and through the vertical channels 61A–61H to an underlying circuit board 67.

Figure 7:
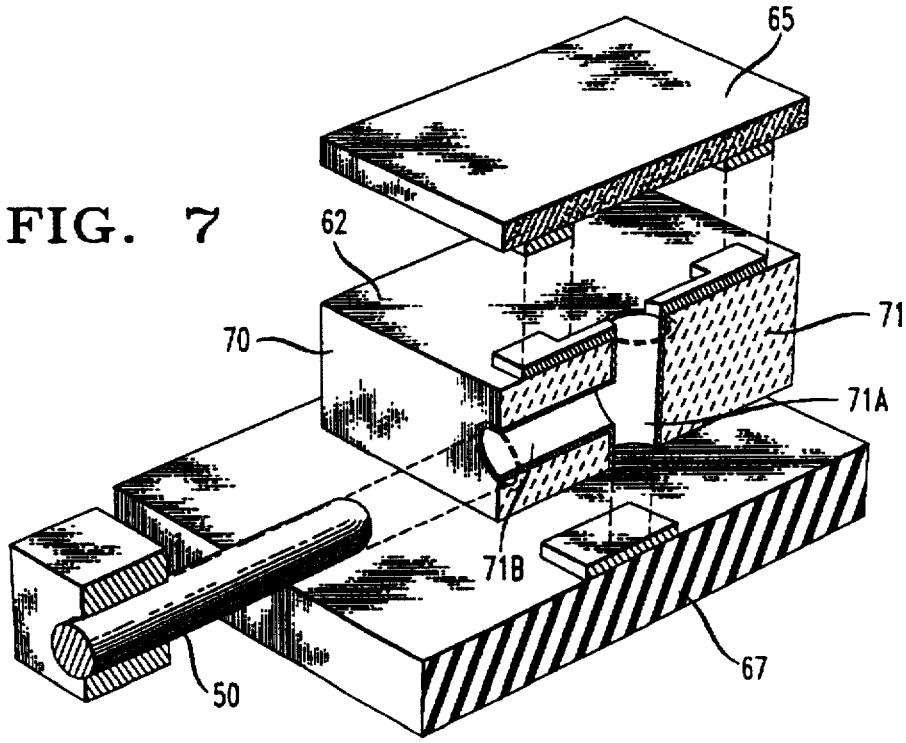
FIG. 7 is a cross sectional view of a third embodiment employing channels that are both vertical and horizontal.

FIG. 7 is a cross sectional view of a third embodiment of the device employing conductively coated channels 71 that are both vertical and horizontal. Specifically, the channel has a vertical component 71A extending between parallel surfaces 62 and a horizontal component 71B extending from surface 70 (perpendicular to 62) to at least the vertical component 71A. This device can provide conductive T-junctions, permitting interconnection among an array of horizontal contacts 50, an integrated circuit 65 and a PC board 67. For even greater connectivity, horizontal channel component 71B can extend through the body.

The invention can be understood in greater detail by consideration of the following specific example.

EXAMPLE 1

A ferrite substrate (11.4×26.7 mm) with two parallel rows of ten 1.1 mm diameter holes each, was obtained from Steward Inc. (Chattanooga, Tenn.). Using a variable speed flexible-shaft hand-held grinder and a grinder bit (0.029" diameter), the pattern depicted in FIGS. 2 and 3 was grinded onto the ferrite piece. The trenches are about 16–20 mils wide and 2–3 mil deep. The ferrite piece was completely metallized by using the thermal reduction process described in U.S. patent application Ser. No. 08/268487 filed on Jun. 30, 1994. The ferrite sample was first heat-treated in a tubular furnace with a flowing forming gas (15% $H_2$+85% $N_2$) or nitrogen. The heat treatment consisted of heating from room temperature to 350° C. in 30 minutes, holding it at 350° C. for 45 minutes in forming gas, heating to and holding at 550° C. in nitrogen for 15 minutes, and then furnace cooling. The metalized sample was then electroplated with 5 microns thick copper in a commercial acid sulfate copper plating bath (CUPRACID from Atotech, State College, Pa.), 2.5 microns of nickel from a commercial nickel sulfamate bath (Barrett, Allied Kelite Div., MacDermid, Waterbury, Conn.), and 1 micron of Au from a conventional gold bath. The metal layer on the front, back and bottom flat surfaces were removed by sanding leaving the inner surface of the holes and the trenches coated with gold/nickel/copper finish.

A printed circuit board with circular pads and lines matching the bottom surface of the ferrite sample was created using a quick prototyping tool. Conventional tin/lead solder paste were placed on the pads. After the ferrite sample was placed on solder paste, the printed circuit board was placed on a conventional conveyor belt furnace to reflow the solder. This EMI suppressing connector on printer circuit board is suitable for mounting IC chips or connecting to cable connectors.

The invention claimed is:

1. An electromagnetic interference suppressing connector device for connecting to an integrated circuit having an array of bonding pads comprising:

an integrated circuit;

a body of ferrite material, said body having a plurality of channels therethrough and having at least one planar surface which does not intersect said channels;

said channels each including a conductive coating providing a continuous electrical path through said body;

said planar surface including a coated pattern of conductive leads and a plurality of bonding pads, said bonding pads on said surface configured in an array for electrically connecting to said integrated circuit, and said leads connecting said conductive channel coatings to respective bonding pads on said surface providing a plurality of separate interference suppressing conductive paths to said integrated circuit.

2. A device comprising an integrated circuit and a circuit board, said integrated circuit connected to said circuit board through a connector device of claim 1.

3. A device according to claim 1 wherein said body of ferrite material comprises a rectangular parallelepiped having three mutually perpendicular pairs of parallel surfaces, said plurality of channels pass through said body between a pair of parallel surfaces, said array of bonding pads is disposed on a surface perpendicular to the pair of surfaces between which said channels pass, and said conductive leads extend from said channels to respective ones of said bonding pads to form a plurality of separate conductive paths to said integrated circuit.

4. An electromagnetic interference suppressing connector device comprising:

a body of ferrite material, said body comprising a rectangular parallelepiped having three mutually perpendicular pairs of parallel surfaces;

a plurality of channels through said body, each said channel including a conductive coating providing a continuous electrical path through said body;

at least one said channel comprising a first channel extending between a first pair of parallel surfaces and an intersecting channel extending from a third surface perpendicular to said first pair.

5. An electromagnetic interference suppressing connector device for connecting to a printed circuit board comprising:

a printed circuit board having an array of bonding pads;

a body of ferrite material, said body having a plurality of channels therethrough and having at least one planar surface which does not intersect said channels;

said channels each including a conductive coating providing a continuous electrical path through said body;

said planar surface including a coated pattern of conductive leads and a plurality of bonding pads connected to said leads, said bonding pads on said surface configured in an array opposing said array on said printed circuit board for electrically connecting said printed circuit board and said leads, and said leads connecting to said conductive channel coatings for providing a plurality of separate interference suppressing conductive paths to said printed circuit board.

6. A device according to claim 5 wherein said body of ferrite material comprises a rectangular parallelepiped having three mutually perpendicular pairs of parallel surfaces, said plurality of channels pass through said body between a pair of parallel surfaces, said array of bonding pads is disposed on a surface perpendicular to the pair of surfaces between which said channels pass, and said conductive leads extend from said channels to respective ones of said bonding pads to form a plurality of separate conductive paths to said printed circuit board.

* * * * *